US005758912A

United States Patent [19]

Hamada

[11] Patent Number: 5,758,912

[45] Date of Patent: Jun. 2, 1998

[54] LATCH MEMBER OF VEHICLE DOOR LATCH DEVICE

[75] Inventor: Yoshikazu Hamada, Yamanashi-ken, Japan

[73] Assignee: Mitsui Kinzoku Kogyo Kabushiki Kaisha, Tokyo, Japan

[21] Appl. No.: 786,980

[22] Filed: Jan. 24, 1997

[30] Foreign Application Priority Data

Jan. 25, 1996 [JP] Japan ..... 8-031317

[51] Int. Cl.[6] ..... E05C 3/04

[52] U.S. Cl. ..... 292/216; 292/340

[58] Field of Search ..... 292/216, 340, 292/341.17

[56] References Cited

U.S. PATENT DOCUMENTS 3,667,791 6/1972 Kazaoka ..... 292/216
3,809,416 5/1974 Kazoaka ..... 292/216
4,538,845 9/1985 Yamada ..... 292/216
4,906,035 3/1990 Nagai ..... 292/216

*Primary Examiner*—Flemming Saether
*Attorney, Agent, or Firm*—Browdy and Neimark

[57] ABSTRACT

A vehicle door latch device comprises a latch body made of synthetic resin and having a recess at a front side thereof, a latch member rotatably mounted in the recess by a latch shaft for engaging with a striker and having an open position, a half-latch position and a full-latch position, a ratchet rotatably mounted in the recess and having a pawl portion for engaging with the latch member. The latch member has a first side surface incorporating a contact point with which the striker comes into contact when the door is closed while the latch member is in the full-latch position. The first side surface has a predetermined length defined between a first door opening side end and a first door closing side end. The first side surface is an arc having a uniform radius measured from the latch shaft or an arc having a distance from the latch shaft which gradually increases therealong from the first door closing side end to the first door opening side end.

6 Claims, 5 Drawing Sheets

LATCH MEMBER OF VEHICLE DOOR LATCH DEVICE

BACKGROUND OF THE INVENTION

The present invention relates to an improved latch member of a vehicle door latch device.

RELATED ART

Referring to FIGS. 1 to 4 which show a prior art well-known door latch device fixed to a vehicle door, the door latch device comprises a latch member A adapted to be engaged with a striker B secured to a vehicle body, and a ratchet C adapted to be engaged with the latch member A for holding the engagement between the latch member A and the striker B. The latch member A and the ratchet C are rotatably received in a recess G formed in the front side of a synthetic resin latch body F by means of a latch shaft D and a ratchet shaft E, respectively. The latch member A is urged by the resilient force of a spring H in a clockwise direction (door opening direction) as viewed in FIG. 1, and abuts against a rubber stopper J when the door is opened. The ratchet C is urged counterclockwise by the resilient force of another spring (not shown).

When the door is closed, the striker B enters a horizontal passage K formed in the latch body F, and then engages with a fork portion L of the latch member A. When the latch member A is turned to a half-latch position through the engagement between the striker B and the fork portion L, a pawl portion M of the ratchet C is engaged with a half-latch step part N of the latch member A, and further, when the latch member A is turned to a full-latch position, the pawl portion M is engaged with a full-latch step part P, then the door is completely closed.

As described above, the latch member A is normally turned to the full-latch position by engaging with the striker B due to the door closing action. However, even though the door is not closed, the latch member A can be displaced into the full-latch position if the latch member A is turned by a finger or a tool such as a screw driver. Should the latch member A be displaced to the full-latch position without the door being closed, it would be natural that the latch member A fails to be engaged with the striker B, as shown in FIG. 2. When an open handle of a door is manipulated so as to release the ratchet C from the latch member A in a condition shown in FIG. 2, the latch member A can be returned to its open position due to the resilient force of the spring H. However, should it be unknown that the latch member A is located at the full-latch position, or should it be forgotten that the latch member A has been displaced to the full-latch position, when the door is closed, the striker B would impinge upon an abutting point S on a side surface R of the latch member A, and accordingly, the door would bounces back. At this time, the conventional latch member A is turned counterclockwise due to impingement upon the striker B, and impinges upon the latch body F which would therefore be damaged.

The above-mentioned problem will be explained in more detail. The side surface R of the latch member A is formed in a substantially straight and planer shape in a part extending from its door opening side end T to its door closing side end U, and the side surface R is also formed such that the distance r to the latch shaft D substantially becomes shorter and shorter from the door closing side end U to the door opening side end T. Accordingly, when the striker B impinges upon the side surface R, the latch member A is turned counterclockwise, thereby the other side surface X of the latch member A impinges upon the peripheral wall Y of the recess C as shown in FIG. 3.

In order to solve the above-mentioned problem, it would be possible that the recess G of the latch body F is widened so as to prevent the latch member A from impinging upon the peripheral wall Y. If the recess G would be widened, the size of the body F would be inevitably large so that a problem of increasing the weight of the latch device would occurs. Further, the above-mentioned problem would be overcome by attaching a protecting metal plate to the peripheral wall Y of the recess G. However, even in this case, the weight of the latch device would be inevitably increased, and further, the time and labor for manufacturing the same would be also increased.

SUMMARY OF THE INVENTION

The present invention is devised in view of the above-mentioned conventional inconveniences, and accordingly, an object of the present invention is to provide a vehicle door latch device which can prevent a latch member from inadvertently turning in a door closing direction even though the door is closed without knowing that the latch member is located at the full-latch position. This is achieved primarily by curving the side of the latch member which will be struck by the striker in a manner that will permit the striker to move on the curved side without pushing the latch member against the latch device. Thus, the latch device will be less likely to be broken in the event of the striker impacting the latch member when in a closed position.

BRIEF DESCRIPTION OF THE DRAWINGS

The above and other objects, features and advantages of the present invention will become apparent from the detailed description of the preferred embodiments found below with reference to the accompanying drawings in which.

DETAILED DESCRIPTION OF THE PREFERRED EMBODIMENTS

Figure 1:
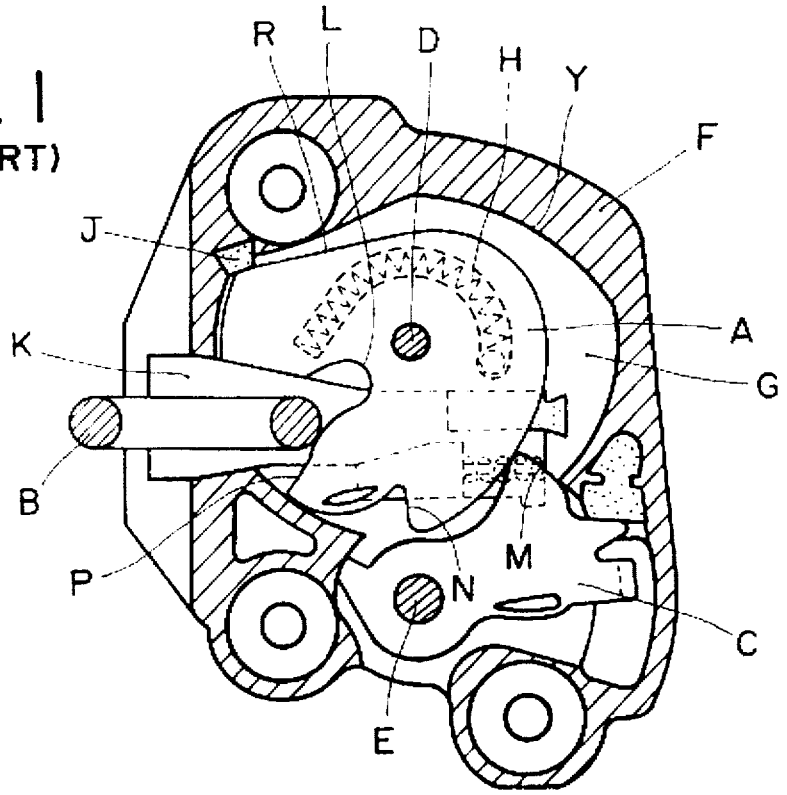
FIG. 1 (PRIOR ART)
FIGS. 1 to 4 are views of a prior art door latch device showing different positions of the latch member.
Figure 2:
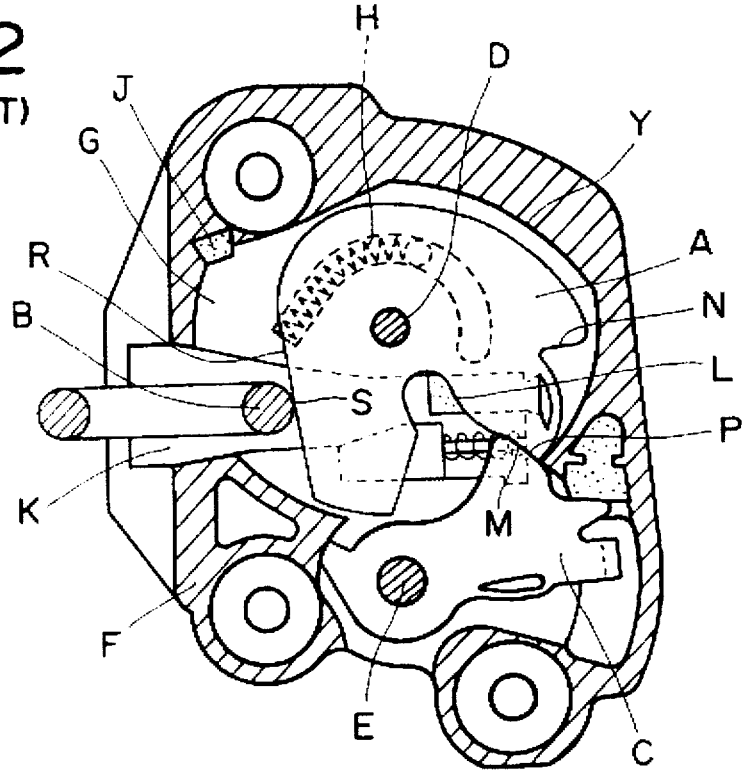
FIG. 2 (PRIOR ART)
Figure 3:
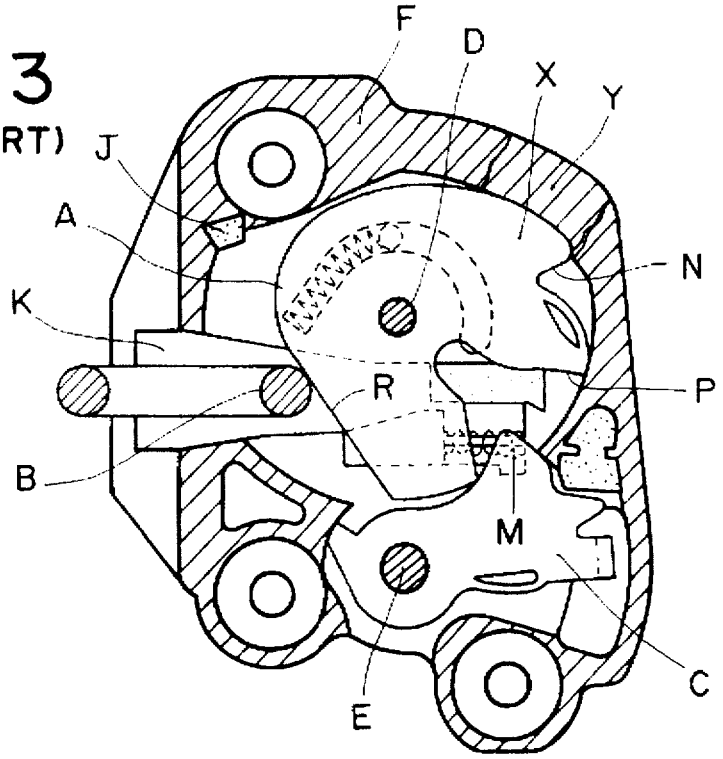
FIG. 3 (PRIOR ART)

FIGS. 5 to 8 which show a door latch device 1 secured to a vehicle door in a first embodiment of the present invention. The door latch device 1 has an improved door latch member 2 adapted to be engaged with a striker 3 secured to the door. The latch member 2 is rotatably received within a recess 6 formed in the front side of a synthetic resin latch body 5 by means of a latch shaft 4. A ratchet 7 which is engaged with the latch member 2 for holding the engagement between the latch member 2 and the striker 3 is also rotatably received in the recess 6 by means of a ratchet shaft 8. The latch member 2 is urged in a clockwise direction (door opening direction) as viewed in FIG. 5 by resilient force of a spring 9, and abuts against a rubber stopper 10 mounted to the latch body 5 when the door is opened. The ratchet 7 is urged counterclockwise by resilient force of another spring (not shown).

The latch body 5 is formed therein with a horizontal passage 11 into which the striker 3 intrudes when the door is closed. The latch member 2 has a U-shaped fork part 12 having an opening 13 which coincides with a moving locus of the striker 3 when the latch member 2 is in its open position where it abuts against the rubber stopper 10 by the resilient force of the spring 9. When the door is closed, the striker 3 intrudes into the horizontal passage 11 and comes into contact with a side surface of the fork part 12 of the latch member 2 to turn the latch member 2 in a direction reverse to the door opening direction.

The latch member 2 is formed at its outer periphery with a half-latch step part 14 and a full-latch step part 15. When the latch member 2 is turned to a half-latch position through the engagement with the striker 3, a pawl portion 16 of the ratchet 7 is engaged with the half-latch step part 14 of the latch member 2, and further, when the latch member 2 is turned to a full-latch position, the pawl portion 16 is engaged with the full-latch step part 15 so that the door is completely closed. It is noted that the striker 3 abuts against an elastic member 17 provided in the terminal end part of the horizontal passage 11 when the latch member 2 is displaced to the full-latch position, and accordingly, a rightward moment of the striker is absorbed by the elastic member 17.

Figure 7:
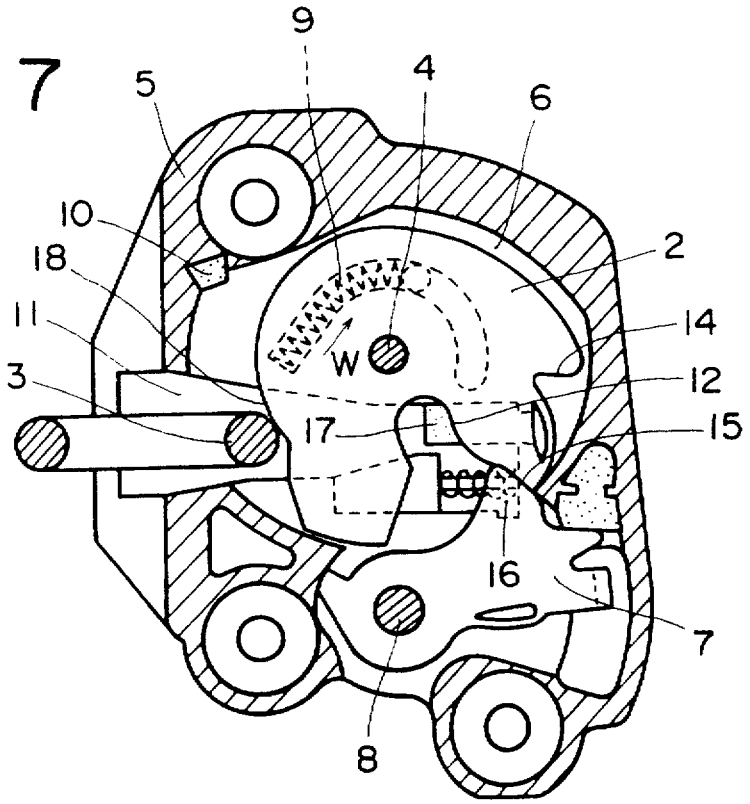
Figure 8:
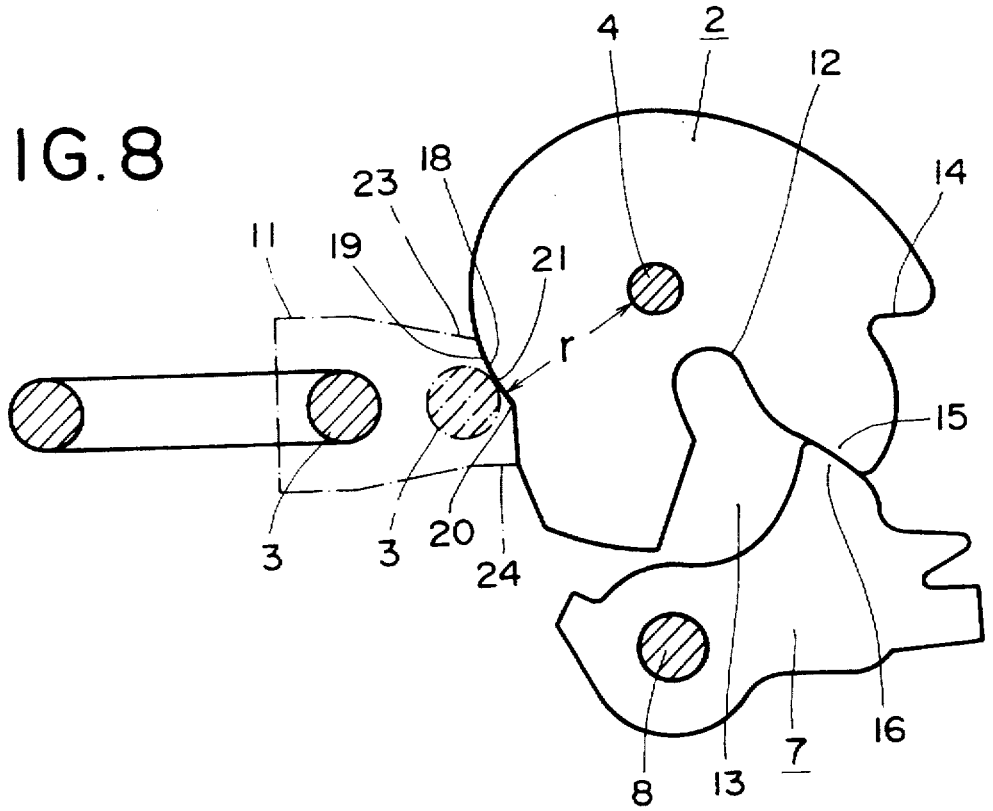

An arcuate side surface 18 is formed at the outer periphery of the improved latch member 2 according to the present invention, as best shown in FIG. 8. The side surface 18 shown in FIGS. 5 to 8, is an arc having a uniform radius r measured from the latch shaft 4. The side surface 18 is arranged in such a way that it coincides with the moving locus of the striker 3 when the latch member 2 is in the full-latch position. Since the moving locus of the striker 3 is vertically shifted more or less, depending upon a position of attachment of the striker 3 and the latch device 1, an upper limit point or a door opening side end 19 of the side surface 18 and a lower limit point or a door closing side end 20 of the side surface 18 are set in consideration with a range of vertical shifts of the moving locus of the striker 3. It is noted that a maxim range of vertical shifts of the moving locus of the striker is equal to that obtained by subtracting the diameter of the striker 3 from the distance between an upper surface 23 and a lower surface 24 of the horizontal passage 11.

When the door is closed without knowing that the latch member 2 is located at the full-latch position, the striker 3 abuts against a contact point 21 of the side surface 18. The striker 3 having abutted against the side surface 18 tends to further move rightward as viewed in FIGS. 6 and 8. However, the latch member 2 cannot be turned even though the latch member 2 makes contact with the striker 3 since the side surface 18 is the arc having a center located on the latch shaft 4. The rightward moment of the striker 3 is absorbed by the tough latch shaft 4. In order to further move the striker 3, it is required that the distance between the striker 3 and the latch shaft 4 gradually decreases, but since the side surface 18 is an arc, the distance between the striker 3 and the latch shaft is always uniform even though the latch member 2 is moved in either direction, and accordingly, the rightward movement of the striker 3 does not always turn the latch member 2. Accordingly, even though the door is closed without knowing that the latch member 2 is located at the full-latch position, it is possible to prevent the latch body from being damaged.

It is noted that the latch shaft 4 instantly moves away from the striker 3 in the direction of the arrow W, as shown in FIG. 7 when it bears the rightward moment of the striker 3. However, the movement of the latch shaft 4 in the direction of the arrow W does not mean that the movement of the door itself in the direction of the arrow W and the movement of the door in the direction of the arrow W is in a direction which is different from the direction of movement which is inherently allowed for the door. Accordingly, the latch shaft 4 does not move substantially.

Figure 4:
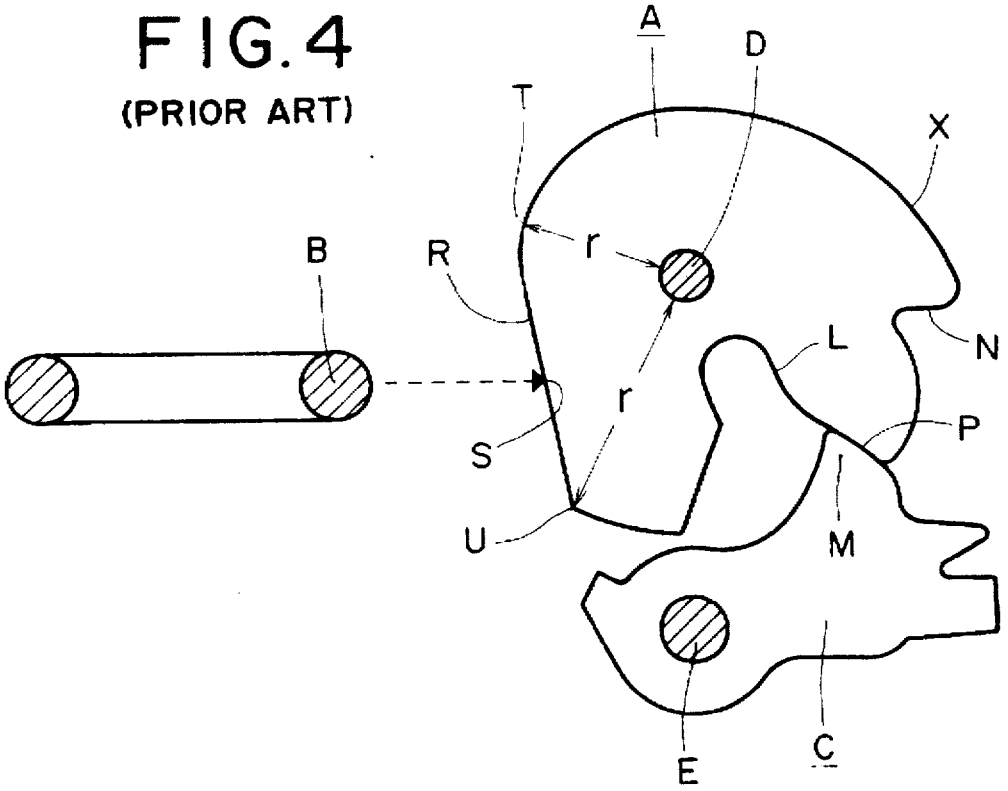
FIG. 4 (PRIOR ART)
Figure 5:
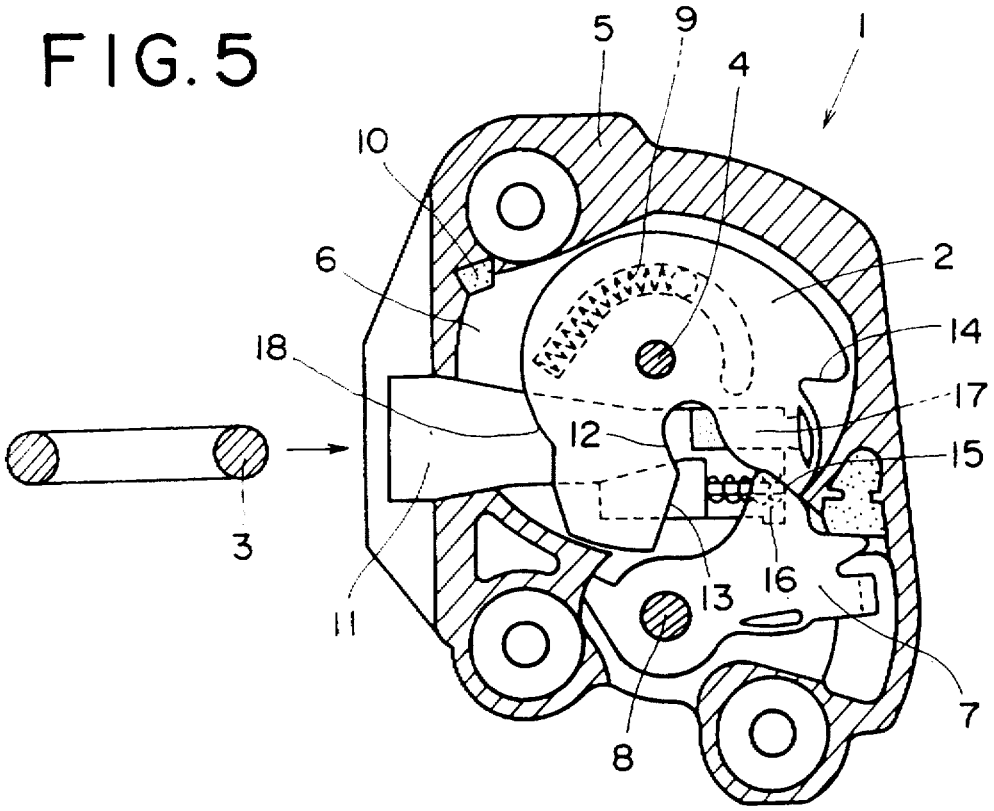
FIG. 5 to 8 are views showing a first embodiment of a door latch device having a latch member according to the invention showing difference positions of a door striker engaging the door latch in a first embodiment of the present.
Figure 6:
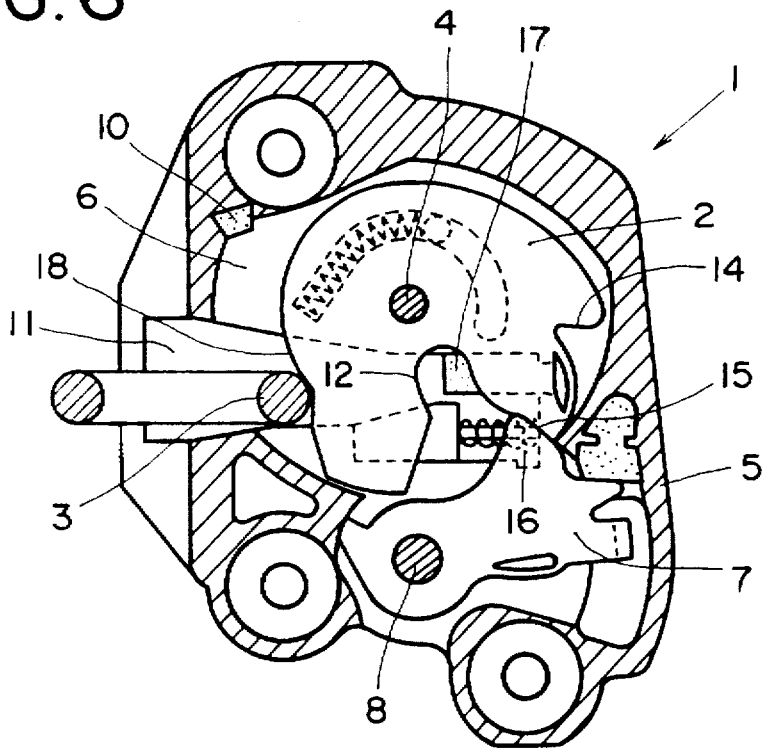
Figure 9:
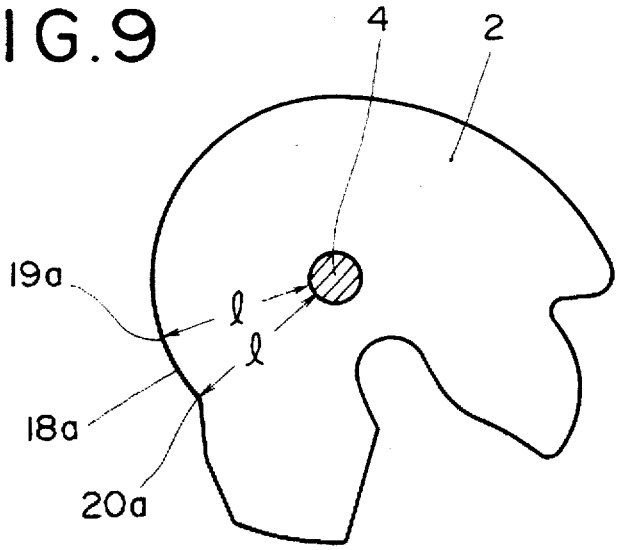
FIG. 9 is an enlarged view illustrating a latch member in a second embodiment of the present invention.

Referring to FIG. 9 which shows a latch member **2*a* in a second embodiment of the present invention, the latch member 2*a* is formed with a side surface 18*a* which is designed so as to have a distance l from the latch shaft 4 which becomes longer and longer therealong from a door closing side end 20*a* to a door opening side end 19*a*. It should be compared with the side surface R of the conventional latch member A shown in FIG. 4, which is contrary to the side surface 18*a* in the second embodiment. With the thus designed latch member 2*a*, when the striker 3 abuts against the striker 18*a*, the rightward moment of the striker 3 gives a torque which turns the latch member 2*a* in the door opening direction. That is, when the latch member 2*a* is turned in the door opening direction, the striker 3 can approach the latch shaft 4**.

Figure 10:
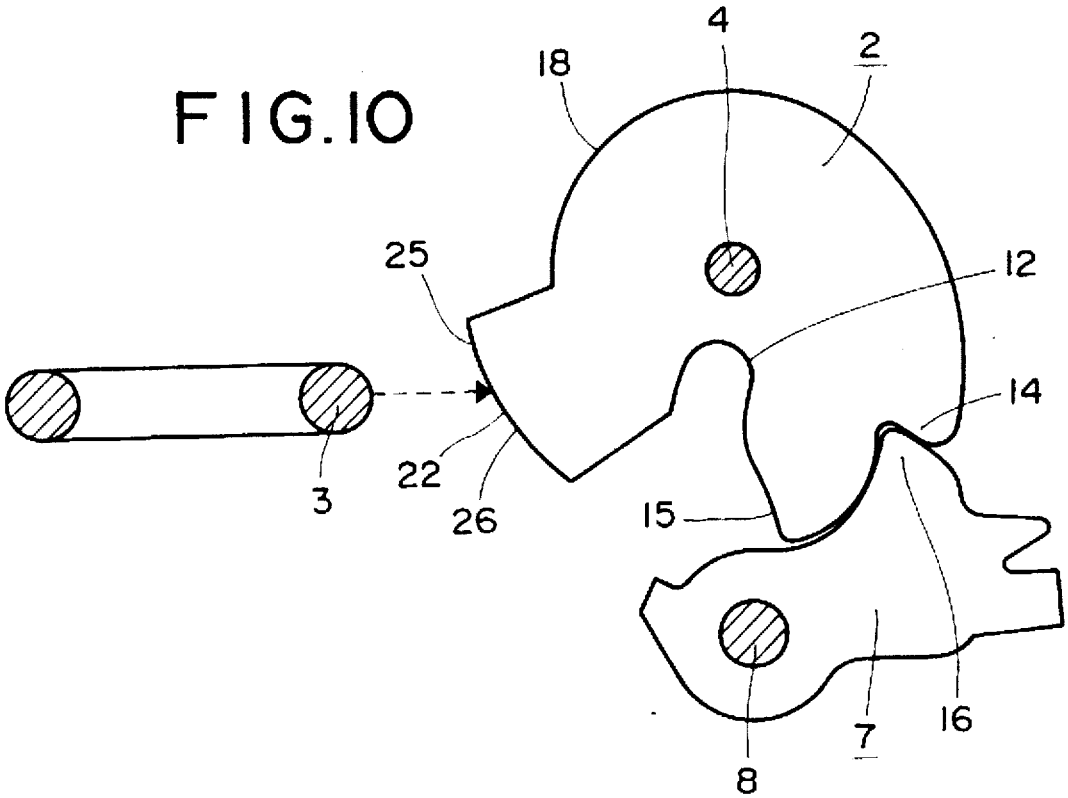
FIG. 10 is an enlarged view illustrating a latch member similar to that in the first embodiment, except having a different side surface.

Referring to FIG. 10 which shows an embodiment in which another side surface 22 is formed on the latch member **2*b* shown in FIG. 8, the side surface 22 is located on the moving locus of the striker 3 when the latch member 2*b* is in the half-latch position. The side surface 22 is formed between a door opening side end 25 and a door closing side end 26, and is an arc having a uniform radius measured from the latch shaft 4. If the door is closed without knowing that the latch member 2*b* is located at the half-latch position, the striker 3 abuts against the side surface 22. However, the latch member 2*b* cannot be turned by the engagement with striker 3. Since the side surface 22 is the arc having a center located on the latch shaft 4. It is noted that the side surface 22 can be designed with the conception the same as that of the side surface 18*a* of the latch member 2*a* shown in FIG. 9. The side surface 22 corresponding to the half-latch position is not always necessary since a sufficient distance is left until the latch member 2 impinges upon the latch body 5 even though the latch member 2 is turned in the door closing direction due to impingement of the striker 3, and accordingly, there is less risk of occurrence of a shock which damages the latch body 5**.

The foregoing discussion discloses and describes merely exemplary embodiment of the present invention only. One skilled in the art will readily recognize from such discussion, and from the accompanying drawings and claims, that various changes, modifications and variations can be made therein without departing from the spirit and scope of the invention as defined in the following claims.

What is claimed is:

1. A vehicle door latch device comprising:

a latch body made of synthetic resin and attached to a door, said latch body having a recess at a front side thereof;

a latch member rotatably mounted in the recess by a latch shaft, said latch member having a U-shaped groove for engaging with a striker secured to a vehicle body, said latch member further having an open position in which the groove is disengaged with the striker, a half-latch position in which the groove is initially engaged with the striker and a full-latch position in which the groove is completely engaged with the striker;

a ratchet rotatably mounted in the recess by means of a ratchet shaft and having a pawl portion for engaging with the latch member to hold the latch member in the half-latch position or the full-latch position;

wherein said latch member has a first side surface incorporating a contact point with which the striker comes into contact when the door is closed while the latch member is in the full-latch position, said first side surface having a predetermined length defined between a first door opening side end (19) and a first door closing side end (20), said first side surface having an arc having a uniform radius measured from the latch shaft;

wherein said U-shaped groove communicates with an inner end of an opening which coincides with a moving locus of the striker when the latch member is in the open position, said distance between the first side surface and the latch shaft being shorter than a distance between an outer end of the opening and the latch shaft.

2. A vehicle door latch device as set forth in claim 1, wherein said latch body is formed therein with a horizontal passage into which the striker intrudes when the door is closed, said passage having an upper surface and a lower surface, said length of the first side surface being substantially equal to a length by which the striker can move up and down in the horizontal passage.

3. A vehicle door latch device as set forth in claim 1, wherein said latch member has a second side surface with which the striker comes into contact when the door is closed while the latch member is in the half-latch position, said second side surface having a predetermined length defined between a second door opening side end and a second door closing side end, said second side surface being an arc having a uniform radius measured from the latch shaft, said distance between the second side surface and the latch shaft is longer than the distance between the first side surface and the latch shaft.

4. A vehicle door latch device comprising:

a latch body made of synthetic resin and attached to a door, said latch body having a recess at a front side thereof;

a latch member rotatably mounted in the recess by a latch shaft, said latch member having a U-shaped groove for engaging with a striker secured to a vehicle body, said latch member further having an open position in which the groove is disengaged with the striker, a half-latch position in which the groove is initially engaged with the striker and a full-latch position in which the groove is completely engaged with the striker;

a ratchet rotatably mounted in the recess by means of a ratchet shaft and having a pawl portion for engaging with the latch member to hold the latch member in the half-latch position or the full-latch position;

wherein said latch member has a first side surface incorporating a contact point with which the striker comes into contact when the door is closed while the latch member is in the full-latch position, said first side surface having a predetermined length defined between a first door opening side end (19) and a first door closing side end (20), said first side surface having an arc having a distance from the latch shaft which gradually increases therealong from the first door closing side end (19) to the first door opening side end (20);

wherein said U-shaped groove communicates with an inner end of an opening which coincides with a moving locus of the striker when the latch member is in the open position, said distance between the first side surface and the latch shaft being shorter than a distance between an outer end of the opening and the latch shaft.

5. A vehicle door latch device as set forth in claim 4, wherein said latch body is formed therein with a horizontal passage into which the striker intrudes when the door is closed, said passage having an upper surface and a lower surface, said length of the first side surface being substantially equal to a length by which the striker can move up and down in the horizontal passage.

6. A vehicle door latch device as set forth in claim 4, wherein said latch member has a second side surface with which the striker comes into contact when the door is closed while the latch member is in the half-latch position, said second side surface having a predetermined length defined between a second door opening side end and a second door closing side end, said second side surface an arc having a distance from the latch shaft which gradually increases therealong from the second door closing side end to the second door opening side end, said distance between the second side surface and the latch shaft is longer than the distance between the first side surface and the latch shaft.

* * * * *